US006711794B1

(12) United States Patent
McClure

(10) Patent No.: US 6,711,794 B1
(45) Date of Patent: Mar. 30, 2004

(54) STARTING AND ENDING PLATFORM FOR A ROOF SEAMING MACHINE

(75) Inventor: Richard R. McClure, Basehor, KS (US)

(73) Assignee: Butler Manufacturing Company, Kansas City, MO (US)

( * ) Notice: Subject to any disclaimer, the term of this patent is extended or adjusted under 35 U.S.C. 154(b) by 0 days.

(21) Appl. No.: 10/409,060

(22) Filed: Apr. 9, 2003

(51) Int. Cl.[7] ..... B23P 11/00
(52) U.S. Cl. ..... 29/243.5
(58) Field of Search ..... 29/243.5, 243.51, 29/243.517–243.529, 283.5; 72/210, 298, 48, 121

(56) References Cited

U.S. PATENT DOCUMENTS

| | | | | | |
|---|---|---|---|---|---|
| 1,412,060 | A | | 4/1922 | Mattson | |
| 3,120,828 | A | | 2/1964 | Gronlund | |
| 3,609,845 | A | * | 10/1971 | Taylor | 29/243.5 |
| 4,027,611 | A | * | 6/1977 | Ward et al. | 29/243.5 |
| 4,072,118 | A | * | 2/1978 | Schultheiss | 72/48 |
| 4,102,285 | A | | 7/1978 | Martin et al. | |
| 4,195,586 | A | | 4/1980 | Martin et al. | |
| 4,334,662 | A | | 6/1982 | Davis et al. | |
| 4,918,797 | A | | 4/1990 | Watkins et al. | |
| 4,989,308 | A | * | 2/1991 | Sanders | 29/243.5 |
| 6,115,899 | A | * | 9/2000 | Rider | 29/243.5 |
| 2002/0133927 | A1 | * | 9/2002 | Morello | 29/243.5 |

* cited by examiner

*Primary Examiner*—Lee D. Wilson
(74) *Attorney, Agent, or Firm*—Shoemaker and Mattare

(57) ABSTRACT

An apparatus for supporting a roof seaming machine on a roof has a frame formed by a pair of spaced support members. Each support member includes an arm having a slotted transverse channel member affixed to one end thereof, and a vertical column is connected to the opposite end of the arm. A platform for supporting the seaming machine is connected to the frame by a pair of hinge knuckles which allow the platform to be folded upward when the machine is not resting on it. The frame is secured to the roof by applying clamps to roof seams where the seams protrude through slots in the channel members, thus enabling the platform to support the machine beyond the edge of the roof.

7 Claims, 2 Drawing Sheets

STARTING AND ENDING PLATFORM FOR A ROOF SEAMING MACHINE

BACKGROUND OF THE INVENTION

This invention relates to a starting and ending platform for a roof seaming machine.

Buildings having roofs formed from panels which are joined edgewise by standing seams are common. The seams typically run down the slope from the ridge of the roof to each eave, perpendicular to the eave.

The panels of a such a roof are normally joined by a machine which folds and crimps vertical flanges of pre-formed panels, forming a seam which stands up above the plane of the roof One such machine is shown in U.S. Pat. No. 4,989,308. The machine has to be placed over the flanges by hand initially, and is removed manually at the end of the seam. Having to lift the machine at the edge of the roof poses dangers for workers. This danger was reduced by prior starting platforms which supported the weight of the machine at the edge of the roof.

Prior patents generally pertinent to this invention include U.S. Pat. Nos. 1,412,060, 4,102,285, 4,195,586, 4,334,662 and 4,918,797.

The prior art platforms pose some problems. For example, a known prior device grips the very seam being worked on, which presents a difficulty when the seam is just being started, since workers have to remove the clamp as the seamer is moving up the seam.

With the Butler MR-24® Roof System, a seaming machine called a Roof Runner®, which is shown in U.S. Pat. No. 3,120,828, is used to seam the corrugations. To start the Roof Runner®, it is necessary that it be placed beyond the eave of the roof The seaming machine has been supported at this point by a platform that extends beyond the eave. The platform is secured, by clamping, to the very corrugation being seamed.

The normal seaming process is to install the panels down one side of the building roof and then proceed back on the other side. There are projects, however, where both sides of the roof are installed at once. In these situations, either the panels must be seamed from eave to ridge on one side and from ridge to eave on the other slope, or a left hand machine must be used on one slope. Catching and removing the Roof Runner at the end of a down slope run can be dangerous.

SUMMARY OF THE INVENTION

An object of the invention is to provide a starting and ending platform for a roof seaming machine which will safely support loads over the eave of a roof, and which attaches to seams other than the seam being created.

These and other objects are attained by a starting and ending platform for a roof seaming machine as described below.

The new platform provides a way of attaching the platform to adjacent corrugations that eliminates the need for a gate, as currently used, and the vertical frame provides some additional security to the operator of the seamer.

The new platform adjusts to accommodate 12" through 24" wide panels.

It provides redundant attachment points, thus greater security in retaining the platform during seaming operations, and uses twice the number of clamps.

The invention also enables the operator to straighten the Roof Runner machine when placing it on the panel seam for starting the seaming operation.

The platform folds up when not in use to minimize storage volume and shipment-packaging requirements.

The platform may be used at the gable trim of the roof, and supports the leading edge on the roof panel, rather than from the gable trim (which may or may not be attached when it is seamed in).

BRIEF DESCRIPTION OF THE DRAWINGS

In the accompanying drawing.

DESCRIPTION OF THE PREFERRED EMBODIMENT

Figure 1:
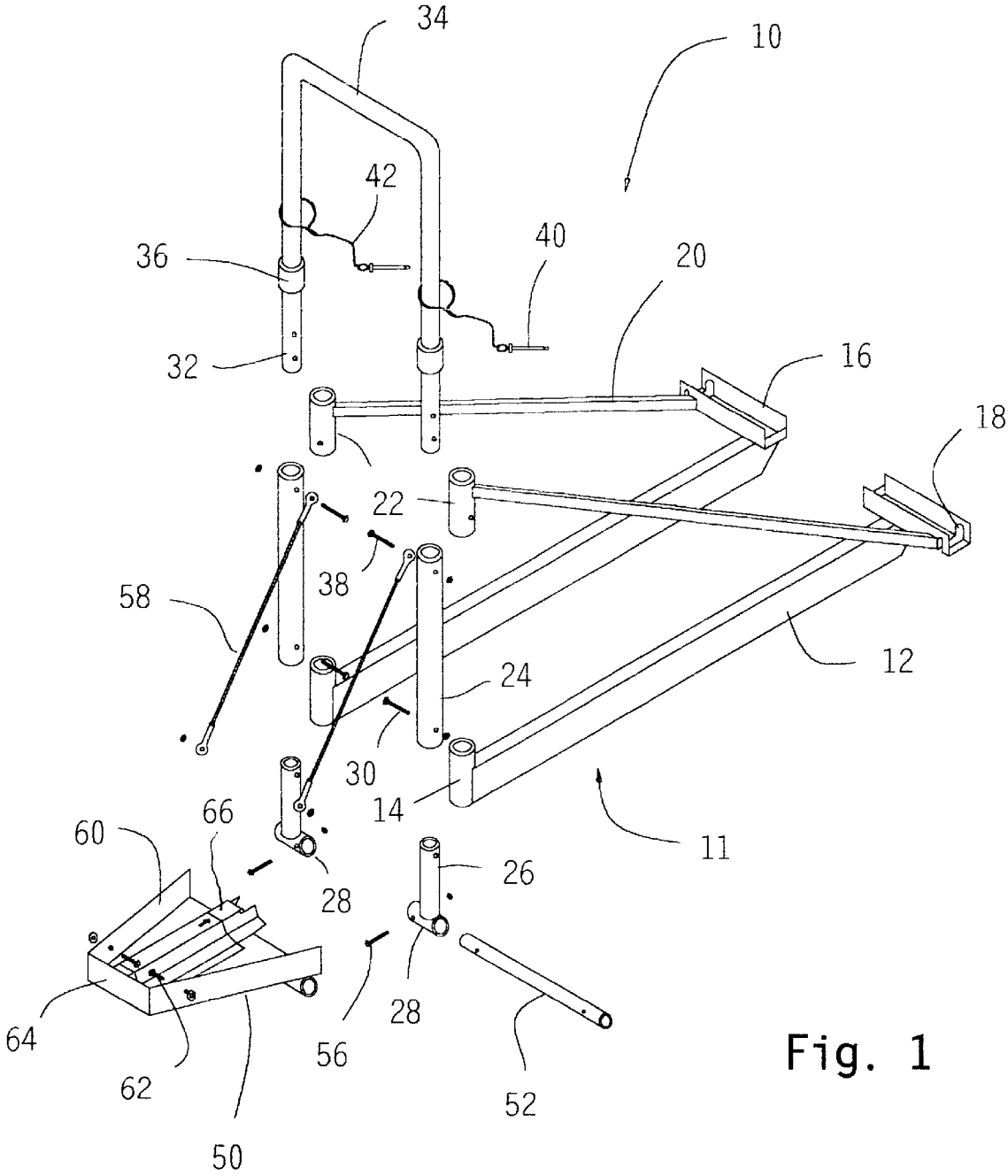
FIG. 1 is an exploded isometric view of a starting and ending platform for a roof seaming machine embodying the invention.

A device embodying the invention, as shown in FIG. 1, includes a frame 10 which includes a pair of roof-engaging support assemblies 11, each of which includes an arm 12 made of structural steel. A lower sleeve 14 is welded to one end of the arm and extends along a vertical axis perpendicular to the length of the arm. A channel member 16 is welded across the top surface of the opposite end of the arm, the length of the channel member being horizontal and perpendicular to the length of the arm. A slot 18, extending parallel to the length of the arm, is cut in the bottom of each channel member. The spacing between the slots is twice the roof seam spacing, for a reason which will be apparent. A brace 20 extends diagonally back from the end of the channel. An upper sleeve 22, coaxial with the lower sleeve, is welded to the upper end of the brace.

A removable tubular column 24 extends between the upper and lower sleeves, on the same vertical axis. The column is retained in this position from below by a vertical leg 26 which extends upward from a knuckle 28. The upper end of the leg is inserted through the lower sleeve into the lower end of the column, where it is retained by a fastener 30 which passes through aligned holes in the column and the leg. The upper end of the column is retained in alignment with the upper sleeve by a tubular free end 32 of a handle 34. Collars 36 on the ends 32 of the handle limit its insertion depth. Fasteners 38 and pins 40 (on tethers 42) retain the handle within the upper sleeves and columns.

The platform 50 is supported on a crossbrace 52 which passes through both a tube 54 welded to the bottom of the platform and bores of the knuckles 28 on either side. The crossbrace is retained by fasteners 56 which pass through holes in it and in the knuckles. The platform can pivot upward freely, but its downward movement is limited to about horizontal by a pair of eye-terminated wire cables 58. The upper end of each cable is secured to the column by a fastener 38, while the lower end is connected to a side wall 60 by means of a bolt 62. An end wall 64 extends between the two side walls. The platform has a raised corrugation 66 between the side walls. The corrugation is shaped to conform to a corresponding seam rib on a target metal roof.

Figure 2:
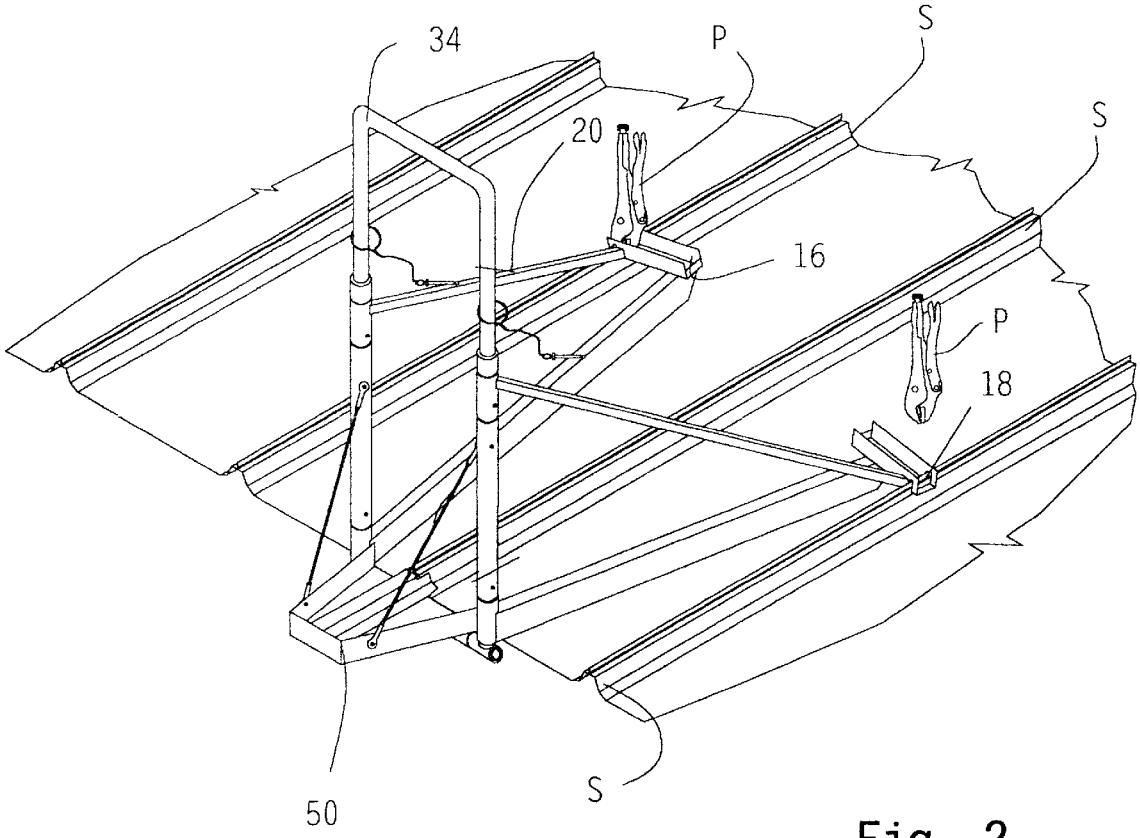
FIG. 2 is a similar view, showing the machine in operation.

In use (FIG. 2), the apparatus is placed on a roof, with the platform end near the eave, and the arms extending upslope from the eave. The device spans three seams "S" of the roof: the central seam runs under or toward the rib on the platform, while the outer seams are aligned with the slots 18 in the channels 16, and protrude through the slots when the device is properly seated on the roof Now a clamp, such as locking pliers "P" , is applied to each seam where it passes through the slot 18, to lock the apparatus in position, and to prevent it from tipping when weight is applied to the platform. A worker can now place the seaming machine on the platform and begin the seaming process.

Since the invention is subject to modifications and variations, it is intended that the foregoing description and the accompanying drawings shall be interpreted as only illustrative of the invention defined by the following claims.

I claim:

1. An apparatus for supporting a roof seaming machine at an edge of a metal roof having seams perpendicular to said edge, said apparatus comprising a frame including a pair of columns, a pair of support members, each comprising an arm having affixed thereto a channel member having a slot for receiving a roof seam, a vertical column extending upward from an opposite end of the arm, means for connecting the arm to a respective one of the columns, a handle having ends received within and interconnecting said columns, a platform, and a hinge knuckle for pivotally connecting the platform to said frame.

2. An apparatus for supporting a roof seaming machine at an edge of a metal roof having parallel seams perpendicular to said edge, said apparatus comprising a frame adapted to rest on the roof, and a platform hinged to the frame, wherein the frame includes a pair of support members each having means for engaging respective parallel seams of the roof wherein each said support member comprises an arm, means at one end of the arm for engaging a roof seam, a vertical column extending upward from an opposite end of the arm, means for connecting each arm to a respective one of the columns, and a handle connected between said columns.

3. The invention of claim 2, further comprising means for limiting downward pivoting movement of the platform while permitting upward pivoting movement.

4. The invention of claim 3, wherein said limiting means are wire cables extending between said columns and said platform.

5. The invention of claim 2, wherein the roof seam engaging means comprises a channel member having a slot therein extending parallel to the length of the arm through which a seam of the roof can protrude to permit a clamp to be applied to secure the apparatus to the roof.

6. The invention of claim 2, wherein the platform is hinged to the frame by a pair of knuckles, each knuckle being attached to a respective one of said arms.

7. The invention of claim 2, wherein the platform has a pair of side walls and a raised corrugation extending between the side walls to clear a corresponding corrugation on the roof.

* * * * *